US009748704B2

(12) United States Patent
Wang

(10) Patent No.: US 9,748,704 B2
(45) Date of Patent: Aug. 29, 2017

(54) SHIELD CONNECTOR STRUCTURE

(71) Applicant: Yazaki Corporation, Tokyo (JP)

(72) Inventor: Feng Wang, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/749,925

(22) Filed: Jun. 25, 2015

(65) Prior Publication Data

US 2015/0295363 A1 Oct. 15, 2015

Related U.S. Application Data

(63) Continuation of application No. PCT/JP2013/084608, filed on Dec. 25, 2013.

(30) Foreign Application Priority Data

Dec. 25, 2012 (JP) ..... 2012-280684

(51) Int. Cl.
*H01R 9/03* (2006.01)
*H01R 9/05* (2006.01)
(Continued)

(52) U.S. Cl.
CPC ..... *H01R 13/6596* (2013.01); *H01R 9/032* (2013.01); *H01R 13/5205* (2013.01);
(Continued)

(58) Field of Classification Search
CPC ..... H01R 9/0518; H01R 13/5221; H01R 13/6592; H01R 13/6596; H01R 13/5205; H01R 4/646; H01R 9/032; H01R 9/034
(Continued)

(56) References Cited

U.S. PATENT DOCUMENTS 6,019,615 A * 2/2000 Masuda ..... H01R 9/0518 174/653
6,280,208 B1 8/2001 Masuda et al.
(Continued)

FOREIGN PATENT DOCUMENTS

JP 2000-294344 A 10/2000

OTHER PUBLICATIONS

International Search Report dated Mar. 25, 2014, issued for PCT/JP2013/084608.
(Continued)

*Primary Examiner* — Renee Luebke
*Assistant Examiner* — Paul Baillargeon
(74) *Attorney, Agent, or Firm* — Locke Lord LLP

(57) ABSTRACT

A shield connector structure is provided that can increase the precision in the size of a connection portion of a shield electric wire and can improve the water-stop performance of the connection portion without being affected by the tolerance of the external diameter of a shield unit and an external insulating covering of the shield electric wire. A shield connector includes a connection member fixed to an outer surface of a metal case and a shield member connecting the connection member and a shield unit of a shield electric wire, and a shield pipe configured to fix an exposed portion of the shield unit to the shield member. A first tubular unit of the shield member is inserted between the exposed portion of the shield unit and an internal insulating covering.

11 Claims, 4 Drawing Sheets

(51) Int. Cl.

| | |
|---|---|
| ***H01R 13/6596*** | (2011.01) |
| ***H01R 13/52*** | (2006.01) |
| ***H01R 13/6592*** | (2011.01) |
| *H01R 13/74* | (2006.01) |
| *H01R 101/00* | (2006.01) |

(52) U.S. Cl.
CPC ..... *H01R 13/5221* (2013.01); *H01R 13/6592* (2013.01); *H01R 9/0518* (2013.01); *H01R 13/748* (2013.01); *H01R 2101/00* (2013.01); *H01R 2201/26* (2013.01)

(58) Field of Classification Search
USPC ..... 439/489, 98, 607.5, 607.51, 607.52, 439/607.41, 578, 95, 99, 101, 108, 585, 439/97; 174/360, 382, 384
See application file for complete search history.

(56) References Cited

U.S. PATENT DOCUMENTS

| | | | | |
|---|---|---|---|---|
| 6,669,511 | B1 | 12/2003 | Yagi et al. | |
| 6,674,005 | B2 * | 1/2004 | Yagi | H01R 9/032 138/123 |
| 8,241,062 | B2 * | 8/2012 | Tsuruta | H01R 9/032 439/352 |

OTHER PUBLICATIONS

Office Action dated Jul. 4, 2016 issued for corresponding Chinese Patent Application No. 2013 800 68158.6.

* cited by examiner

SHIELD CONNECTOR STRUCTURE

TECHNICAL FIELD

The present invention relates to a shield connector structure, and more particularly, to a shield connector structure for connecting a shield electric wire inserted through an insertion hole from one end of a connection target object to the other end thereof with the connection target object.

BACKGROUND ART

In the past, in automobiles (an electric car and a hybrid car in particular), devices such as a motor, a battery, and an inverter are connected to each other by a shield electric wire, and a shield connector structure has been suggested to ground connect the case of the device and the shield electric wire (see, for example, Patent Literature 1). A shield connector structure 100 described in Patent Literature 1 is configured to connect a metal case 6 of a connection target object and a shield electric wire 1 as shown in FIG. 7, and to make the connection portion waterproof. The shield electric wire 1 is a coaxial cable including a conductive body 2, an internal insulating covering 3 covering the periphery of the conductive body 2, a shield unit 4 made of a conductive body such as a braided wire provided on the periphery of the internal insulating covering 3, and an external insulating covering 5 covering the periphery of the shield unit 4. The metal case 6 is provided with an insertion hole 7 into which the shield electric wire 1 is inserted, and a bolt hole 8 into which a bolt 106 for fixing a connection member 101 is screwed.

This shield connector structure 100 includes a housing 101 allowing the shield electric wire 1 to be inserted therethrough and fixed to the metal case 6, a shield member 102 electrically connecting the metal case 6 and the shield unit 4 of the shield electric wire 1, a first seal member 103 interposed between the inner surface of the shield member 102 and the outer surface of the external insulating covering 5 of the shield electric wire 1, a second seal member 104 interposed between the outer surface of the shield member 102 and the inner surface of the insertion hole 7 of the metal case 6, a shield pipe 105 swaged and covering the shield unit 4 connected to the shield member 102, a bolt 106 for fixing the connection member 101 with the metal case 6, and a corrugated tube 107 which is an exterior member covering the shield electric wire 1 at the outside of the metal case 6.

The housing 101 is fixed to one side of the metal case 6 (external side), and is configured to hold the shield member 102 in such a manner that the shield member 102 is sandwiched between the housing 101 and the metal case 6, and includes an insertion unit 111 in which the shield electric wire 1 is inserted, a tubular protrusion unit 112 extending to the other side (inside) of the metal case 6 with respect to the insertion unit 111 and entering into the insertion hole 7, and a flange unit 113 extending to the outside in the diameter direction of the insertion unit 111 and fixed to the metal case 6. The shield member 102 includes a first tubular unit 121, a second tubular unit 122, and a third tubular unit 123, of which diameters increase in three stages from the other end to the one end side of the metal case 6, and includes a flanged portion 124 bent continuously to the third tubular unit 123 and along one surface (outer surface) of the metal case 6.

The shield unit 4 of the shield electric wire 1 is connected to the first tubular unit 121 by removing the external insulating covering 5 at the other side of the metal case 6 to be exposed, bending it to be overlaid on the first tubular unit 121 of the shield member 102, swaging the shield pipe 105 from the outside of the shield unit 4. As described above, the shield unit 4 of the shield electric wire 1 is connected to the first tubular unit 121, and the flanged portion 124 of the shield member 102 is held by the housing 101 and the one side surface of the metal case 6, so that the shield unit 4 is ground connected to the metal case 6 via the shield member 102.

The first seal member 103 is formed in a tubular shape as a whole and made of an elastic material such as rubber, and has lip portion in a protruding and recessed shape and in an annular shape on the inner peripheral surface and the outer peripheral surface thereof, wherein multiple lip portions on the inner peripheral surface are brought into close contact with the outer surface of the external insulating covering 5 of the shield electric wire 1, and multiple lip portions on the outer peripheral surface are brought into close contact with each inner surface of the second tubular unit 122 of the shield member 102 and the tubular protrusion unit 112 of the housing 101, so that the space between the shield electric wire 1 and the shield member 102 and the connection member 101 is configured to be sealed. On the other hand the second seal member 104 is formed in a tubular shape as a whole and made of an elastic material such as rubber, and includes two lines of lip portions on each of the inner peripheral surface and the outer peripheral surface, wherein the lip portions on the inner peripheral surface are brought into close contact with the outer surface of the second tubular unit 122 of the shield member 102, and the lip portions of the outer peripheral surface are brought into close contact with the inner surface of the insertion hole 7 of the metal case 6, so that the space between the shield member 102 and the metal case 6 is configured to be sealed.

As described above, in the conventional shield connector structure 100 described in Patent Literature 1, the shield electric wire 1 is mechanically connected to the metal case 6 by the housing 101, and the shield unit 4 is electrically connected via the shield member 102 to the metal case 6. Further, sealing is provided by the first seal member 103 and the second seal member 104, so that water-stop is provided in the connection portion of the shield electric wire 1 and the metal case 6, and this can prevent water and the like from entering from the outside to the inside of the metal case 6.

CITATION LIST

Patent Literature

Patent Literature 1: JP 2000-294344 A

SUMMARY OF INVENTION

Technical Problem

In the conventional shield connector structure, however, the shield unit 4 of the shield electric wire 1 exposed at the inside of the metal case 6 is bent and overlaid on the first tubular unit 121 of the shield member 102, and it is connected to the shield member 102 by the shield pipe 105 swaged from the outside thereof, and therefore, this increases variation of the external diameter size of the bent shield member 102, and the diameter size at the swaged portion of the shield pipe 105 is not constant. The shield member 102 is overlaid on the external insulating covering 5 of the shield electric wire 1, but the tolerance of the diameter size of the external insulating covering 5 is also large, and therefore, in order to cope with the tolerance of the external diameter of the bent shield member 102 and the external insulating covering 5, a margin should be given to the sizes of the shield member 102 and the shield pipe 105, and therefore, it is necessary to increase the inner diameter of the insertion hole 7 of the metal case 6. Further, since the tolerance of the external diameter of the external insulating covering 5 is large, and therefore, a margin should also be given to the internal diameter of the insertion unit 111 of the connection member 101 in order to allow it to be inserted therethrough, and when an external force is applied to bend the shield electric wire 1, the first seal member 103 pressed on the shield electric wire 1 is off center in the diameter direction, and the water-stop property may be reduced.

The present invention is made in view of the above issues, and it is an object of the present invention to provide a shield connector structure capable of increasing the precision in the size of a connection portion of a shield electric wire and capable of improving the water-stop performance of the connection portion without being affected by the tolerance of the external diameter of a shield unit and an external insulating covering of a shield electric wire.

Solution to Problem

In order to solve the above problem, a shield connector structure according to one aspect of the present invention is a shield connector structure for causing a shield electric wire having a conductive body, an internal insulating covering, a shield unit, and an external insulating covering to be inserted into an insertion hole of a connection target object from one side to the other side and causing the shield electric wire to be connected to the connection target object, and the shield connector structure includes a conductive connection member in which the shield electric wire is inserted and which is fixed to one side of the connection target object, a conductive and tubular shield member connecting the connection member and the shield unit of the shield electric wire, and a circular fixing member configured to fix the shield unit of the shield electric wire with the shield member, wherein the connection member includes a connection member main body fixed to one surface of the connection target object and an electric wire guiding unit penetrating through the connection member main body and allowing the shield electric wire to be inserted from one side to the other side, the shield member is formed to include a shield connection unit connected to one surface of the connection member main body, and a first tubular unit extending from the shield connection unit to one side, and the first tubular unit is inserted between the internal insulating covering and the shield unit of the shield electric wire, and the fixing member is swaged from the outside in the diameter direction of the shield unit toward the first tubular unit, so that the shield unit of the shield electric wire and the shield member are electrically connected.

The shield connector structure according to a first preferred aspect of the present invention is based on the shield connector structure according to the one aspect of the present invention, and the connection member is comprised of a tubular first extended portion extending from the connection member main body to the insertion hole of the connection target object, and the shield connector structure further includes a first seal member interposed between an inner surface of the electric wire guiding unit of the connection member and an outer surface of the internal insulating covering of the shield electric wire, and a second seal member interposed between an outer surface of the first extended portion of the connection member and an inner surface of the insertion hole of the connection target object.

The shield connector structure according to a second preferred aspect of the present invention is based on the shield connector structure according to the one aspect or the first preferred aspect of the present invention, and the connection member is comprised of a tubular second extended portion extending from the connection member main body to one side, and the shield member is formed to include a second tubular unit located at the other side with respect to the first tubular unit and formed to have a large diameter, and a stepped unit coupling the first tubular unit with the second tubular unit, and the second tubular unit and the stepped unit cover the second extended portion of the connection member.

The shield connector structure according to a third preferred aspect of the present invention is based on the shield connector structure according to any one of the one aspect to the second preferred aspect of the present invention, and further includes an exterior member provided at one side with respect to the connection member main body to cover the shield electric wire, the first tubular unit, and the fixing member.

Advantageous Effects of Invention

According to the one aspect of the present invention, the first tubular unit of the shield member extending to one side with respect to the connection target object is inserted between the internal insulating covering and the shield unit of the shield electric wire, and the shield unit of the shield electric wire and the shield member are electrically connected by the fixing member swaged from the outside in the diameter direction of the shield unit, and therefore, it is not necessary to fold back the shield unit, and the precision of the diameter size of the connection portion of the shield member and the shield unit of the shield electric wire can be improved. Further, the external insulating covering is removed at one side with respect to the connection portion of the shield member and the shield unit of the shield electric wire, and the exposed shield unit is overlaid on the first tubular unit of the shield member, and therefore, the external insulating covering and the shield unit are not inserted into the electric wire guiding unit of the connection member, and only the conductive body and the internal insulating covering are inserted through the electric wire guiding unit to the other side of the connection target object. Therefore, the conductive body and the internal insulating covering are inserted that have a smaller tolerance of the external diameter as compared with the external insulating covering and the shield unit, and therefore, the precision of the inner diameter of the electric wire guiding unit of the connection member is increased, and the gap with the internal insulating covering can be formed to be smaller. Therefore, even when external force is applied so as to bend the shield electric wire, a large gap is not formed between the electric wire guiding unit of the connection member and the internal insulating covering, and the reduction in the water-stop property can be prevented. The connection portion between the shield member and the shield unit of the shield electric wire is located at one side with respect to the connection target object, and the connection portion is not located inside of the insertion hole like the conventional technique, and therefore, it is not necessary to provide margin in the inner diameter of the insertion hole of the connection target object, and the water-stop property of the inner peripheral surface of the insertion hole can be improved.

According to the first preferred aspect of the present invention, the first seal member is interposed between the inner surface of the electric wire guiding unit of the connection member and the outer surface of the internal insulating covering of the shield electric wire, so that the first seal member is brought into close contact with the internal insulating covering of which tolerance of the external diameter is small, and sealing can be provided, so that the water-stop performance can be improved. Further, the first extended portion of the connection member is inserted into the insertion hole of the connection target object, and the second seal member is interposed between the outer surface of the first extended portion and the inner surface of the insertion hole of the connection target object, so that the second seal member is brought into close contact with the first extended portion and the insertion hole of which tolerances of the diameter sizes are small, and the sealing can be provided, so that the water-stop performance can be further improved.

According to the second preferred aspect of the present invention, the second extended portion is formed on the connection member, and the second tubular unit and the stepped unit are formed on the shield member, and the second extended portion of the connection member is covered by the second tubular unit and the stepped unit, so that this can prevent entry of water and the like flowing to the gap between the internal insulating covering of the shield electric wire and the electric wire guiding unit of the connection member, and accordingly, water-stop performance can be further improved. Further, the mechanical connection rigidity of the connection member and the shield member can be improved, and even when external force is applied to bend the shield electric wire at one side of the connection target object, the shield electric wire is less likely to be bent inside of the electric wire guiding unit of the connection member, and the reduction of the water-stop property can be prevented more effectively.

According to the third preferred aspect of the present invention, the shield electric wire, the first tubular unit, and the fixing member are covered with the exterior member at one side with respect to the connection member main body, so that the water-stop property at the connection portion between the shield member and the shield unit of the shield electric wire can be improved, and the ground connection of the shield unit can be maintained in a preferable manner by protecting the connection portion.

DESCRIPTION OF EMBODIMENTS

Hereinafter, a shield connector structure according to an embodiment of the present invention will be explained with reference to FIGS. 1 to 4. The shield connector structure of the present embodiment is a connection structure suitable for ground connecting a shield electric wire 1 and waterproofing the connection portion in a case where, e.g., a connection between a motor and an inverter and a connection between a inverter and a battery are made with the shield electric wire 1 in automobiles, and more particularly, in an electric car running with driving force provided by an electric motor and a hybrid car running with driving force provided by both of an engine and an electric motor.

Figure 1:
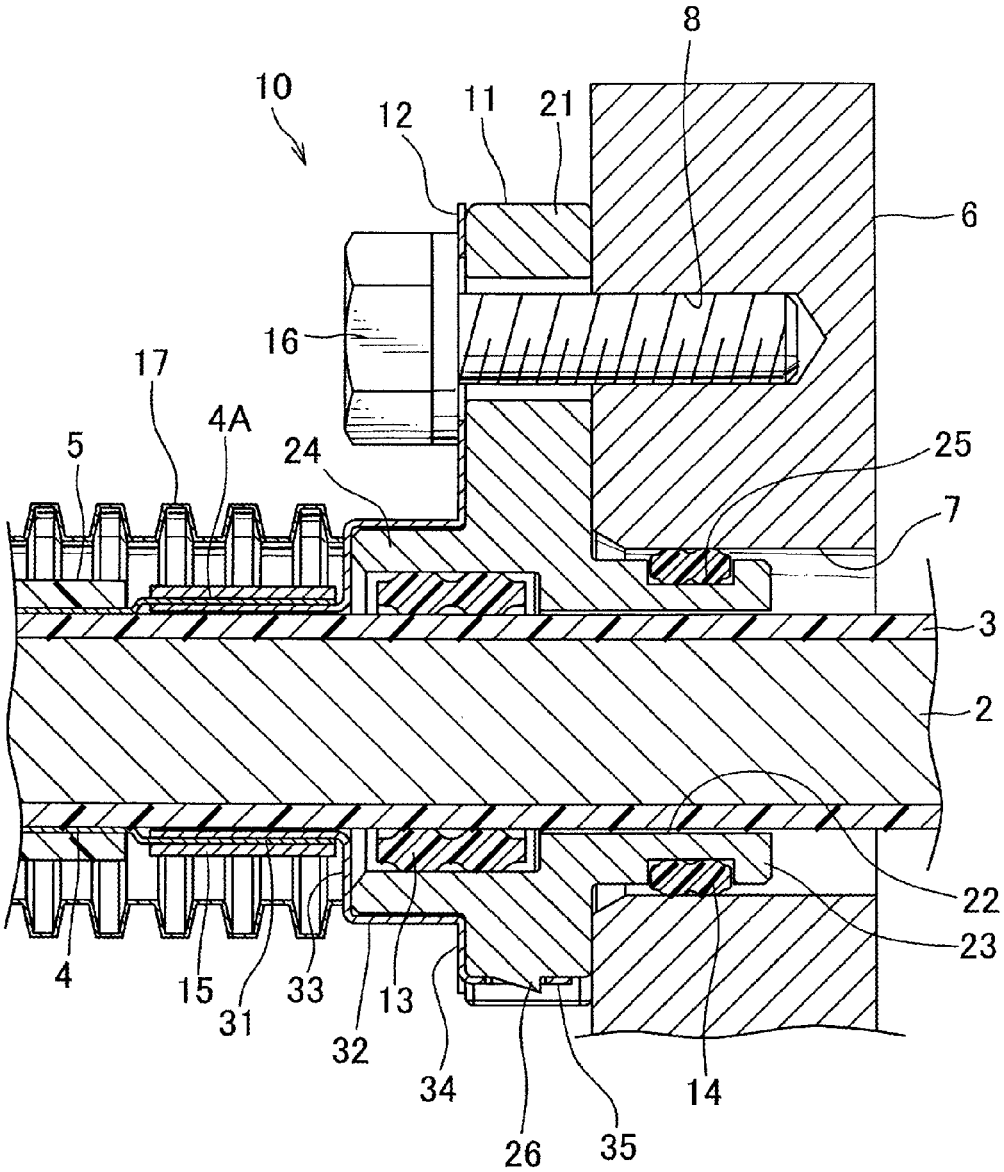
FIG. 1 is a cross sectional view illustrating a shield connector structure according to an embodiment of the present invention.
Figure 2:
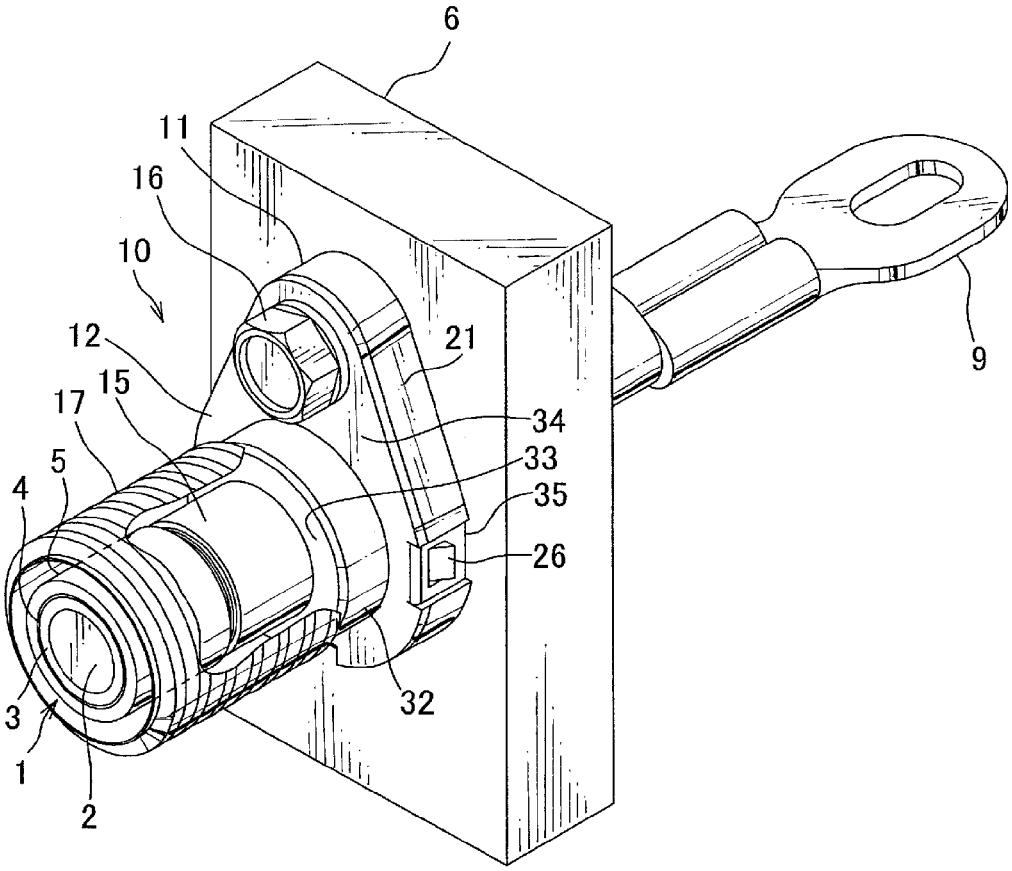
FIG. 2 is a perspective view illustrating the shield connector structure when the shield connector structure is seen from one side of a connection target object.

As shown in FIG. 1, the shield electric wire 1 is a coaxial cable including a conductive body 2 made of a stranded wire and the like made by twisting multiple elemental wires, an internal insulating covering 3 made of insulating plastic and the like covering the periphery of the conductive body 2, a shield unit 4 made of a conductive body such as a braided wire and the like provided around the internal insulating covering 3, and an external insulating covering 5 made of insulating plastic and the like covering the periphery of the shield unit 4. A motor, an inverter, a battery, and the like serving as connection target objects have a metal case 6 constituting the outer shell, and the metal case 6 is provided with an insertion hole 7 in which the shield electric wire 1 is inserted.

The shield electric wire 1 is inserted from the outside (one side) of the metal case 6 via the insertion hole 7 into the inside (the other side) thereof, and a terminal metal piece 9 is fixed to the conductive body 2 at the distal end portion in the inside thereof. This terminal metal piece 9 is connected to an electric connection unit, not shown, in the metal case 6. The shield unit 4 of the shield electric wire 1 is exposed by removing the external insulating covering 5 at the outside of the metal case 6, and is ground connected to the metal case 6 via a shield member 12 and a connection member 11 explained later. The shield unit 4, the connection member 11, and the shield member 12 shield the electromagnetic wave, so that leakage and intrusion of noises from the connection portion can be prevented.

A shield connector 10 includes a conductive connection member 11 into which the shield electric wire 1 is inserted and which is fixed to the outer surface of the metal case 6, a conductive and tubular shield member 12 connecting the shield unit 4 of the shield electric wire 1 and the connection member 11, a first seal member 13 interposed between the inner surface of the connection member 11 and the outer surface of the internal insulating covering 3 of the shield electric wire 1, a second seal member 14 interposed between the connection member 11 and the inner surface of the insertion hole 7 of the metal case 6, a shield pipe 15 serving as a circular fixing member for swaging and fixing the shield unit 4 of the shield electric wire 1 and the shield member 12, a bolt 16 for fixing the connection member 11 to the metal case 6, and a corrugated tube 17 serving as an exterior member covering the shield electric wire 1 at the outside of the metal case 6.

The connection member 11 is a die cast component integrally formed of metal such as aluminum alloy, and is formed to include a connection member main body 21 coming into contact with the outer surface of the metal case 6 to be fixed, an electric wire guiding unit 22 in which the shield electric wire 1 penetrating through the connection member main body 21 is inserted, a first extended portion 23 of tubular-shape provided to extend from the connection member main body 21 into the inside of the insertion hole 7 of the metal case 6, and a second extended portion 24 of tubular-shape provided to extend from the connection member main body 21 to the outside of the metal case 6. The inner diameter of the second extended portion 24 is formed to be larger than the inner diameter of the electric wire guiding unit 22, and the first seal member 13 is provided to be in close contact with the inner peripheral surface of the second extended portion 24. On the outer peripheral surface of the first extended portion 23, a recessed groove portion 25 is formed in a recessed grove shape along the circumferential direction, and the second seal member 14 is held in the recessed groove portion 25. At multiple portions on the outer peripheral surface of the connection member main body 21, latching claws 26 are provided to latch and hold the shield member 12.

Figure 3:
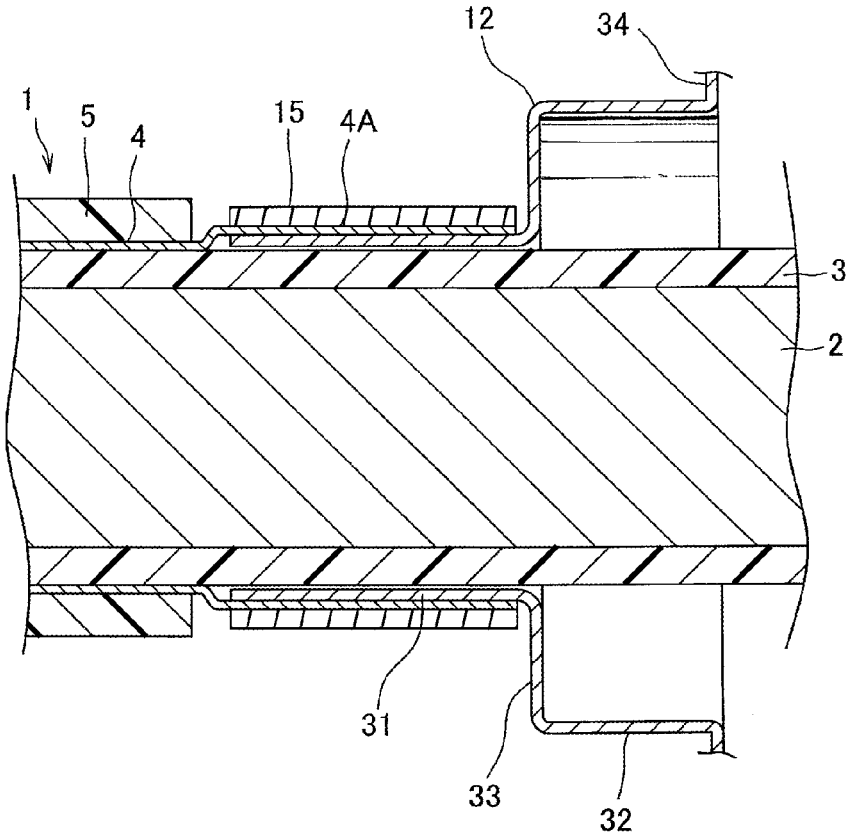
FIG. 3 is a cross sectional view enlarging and illustrating a main portion of the shield connector structure.

The shield member 12 is made of a conductive metal material, and is formed in a stepped tubular shape of which diameter increases in two steps from the outside of the metal case 6 toward the outer surface (one surface). More specifically, as shown in FIG. 3, the shield member 12 is formed to include a first tubular unit 31 connected to the shield unit 4 of the shield electric wire 1, a second tubular unit 32 located at the side of the connection member 11 (the other side) with respect to the first tubular unit 31 and formed to have a larger diameter, a stepped unit 33 connecting the first tubular unit 31 and the second tubular unit 32, and a flanged portion 34 bent continuously to the second tubular unit 32 and along the outer surface of the connection member main body 21. At multiple portions of the flanged portion 34, latched portions 35 are provided. The latched portion 35 bends toward the metal case 6, and is latched by the latching claw 26 of the connection member 11. The flanged portion 34 is formed to have substantially the same external shape as the connection member main body 21, and is provided to be in contact with the outer surface of the connection member main body 21, and the flanged portion 34 is screwed with the bolt 16, so that the shield member 12 is connected to the connection member 11.

Figure 4:
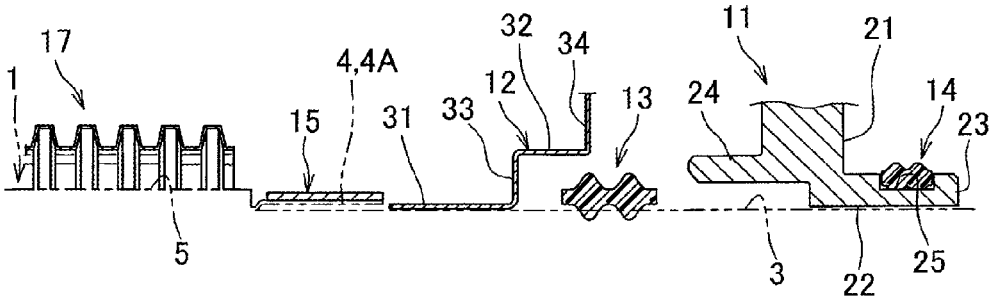
FIG. 4 is a partial cross sectional view illustrating a portion of the shield connector structure in an exploded manner.
Figure 5:
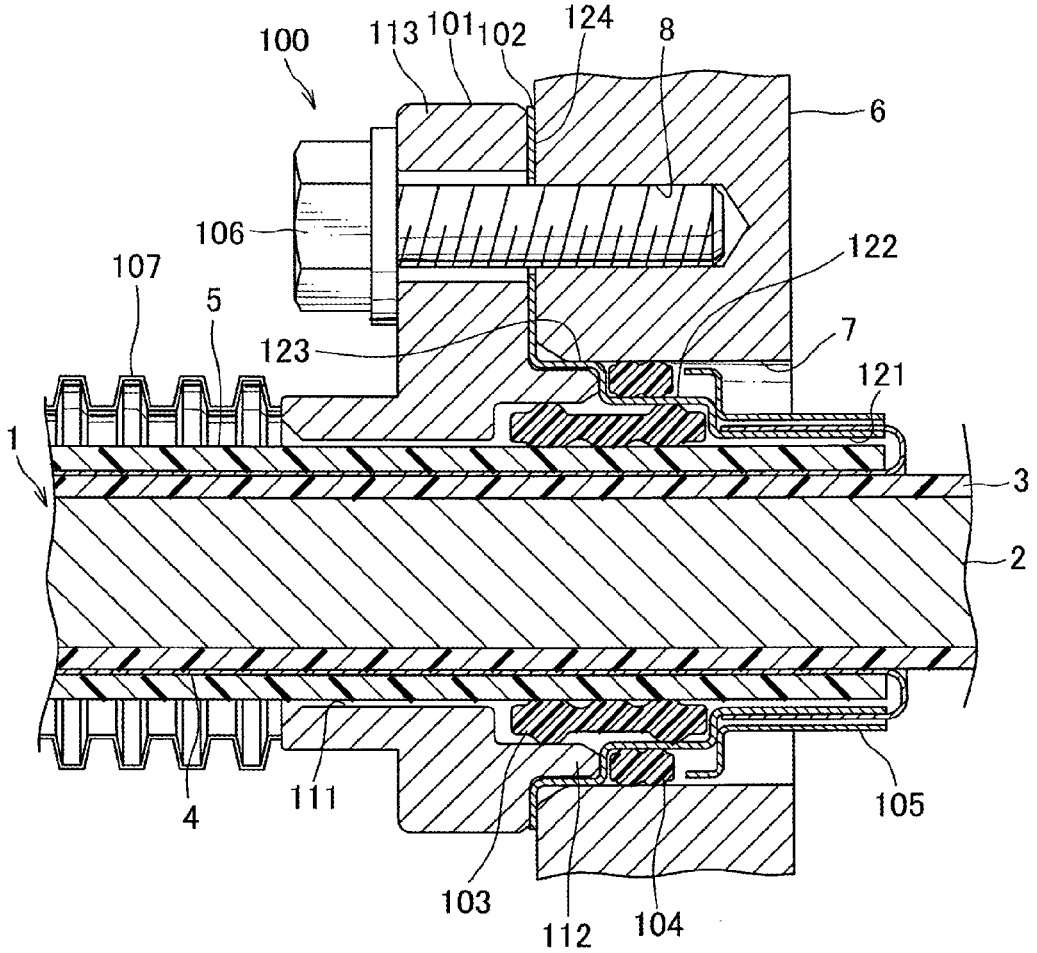
FIG. 5 Prior Art
FIG. 5 is a cross sectional view illustrating a shield connector structure according to a conventional technique.

As shown in FIG. 4, the first seal member 13 is formed in a tubular shape as a whole and made of an elastic material such as rubber, and the first seal member 13 is pressed in so as to be in close contact with the outer peripheral surface of the internal insulating covering 3 along the shield electric wire 1 and the inner peripheral surface of the second extended portion 24 of the connection member 11. Two lines of circular lips are formed on the inner peripheral surface of the first seal member 13, and these circular lips are crushed and pressed against the outer peripheral surface of the internal insulating covering 3, so that the space between the shield electric wire 1 and the first seal member 13 is sealed. In addition, two lines of circular lips are formed on the outer peripheral surface of the first seal member 13, and these circular lips are crushed and pressed against the inner peripheral surface of the second extended portion 24, so that the space between the connection member 11 and the first seal member 13 is sealed.

The second seal member 14 is formed in a tubular shape as a whole and made of an elastic material such as rubber, and the second seal member 14 is provided to be in close contact with the recessed groove portion 25 of the connection member 11 and the inner surface of the insertion hole 7 of the metal case 6. Two lines of circular lips are formed on the inner peripheral surface of the second seal member 14, and these circular lips are crushed and pressed against the recessed groove portion 25, so that the space between the connection member 11 and the second seal member 14 is sealed. In addition, two lines of circular lips are formed on the outer peripheral surface of the second seal member 14, and these circular lips are crushed and pressed against the inner peripheral surface of the insertion hole 7, so that the space between the metal case 6 and the second seal member 14 is sealed.

As described above, the space between the internal insulating covering 3 of the shield electric wire 1 and the insertion hole 7 of the metal case 6 is sealed by the first seal member 13 and the second seal member 14 via the connection member 11, so that the shield electric wire 1 is connected to the metal case 6 in the water-stopped state. The latched portion 35 is latched to the latching claw 26 of the connection member 11, and the flanged portion 34 is fastened to the outer surface of the connection member main body 21 with the bolt 16, so that the shield member 12 is connected to the connection member 11. At this occasion, the second tubular unit 32 and the stepped unit 33 of the shield member 12 are provided to cover the second extended portion 24 of the connection member 11, so that the second extended portion 24 and the first seal member 13 are not exposed to the outside. Further, the first tubular unit 31 of the shield member 12 is inserted between the internal insulating covering 3 and an exposed portion 4A where the shield unit 4 of the shield electric wire 1 is exposed, and is fixed by the shield pipe 15 swaged from the outside of the shield unit 4. Therefore, the shield unit 4 and the shield member 12 are electrically connected, and accordingly, the shield electric wire 1 is ground connected to the metal case 6 via the shield member 12 and the connection member 11. The connection portion of the exposed portion 4A of the shield unit 4 and the first tubular unit 31 of the shield member 12 is covered and protected by the corrugated tube 17.

Subsequently, an example of assembly procedure for fixing the shield electric wire 1 to the metal case 6 will be explained. The assembly procedure of the shield electric wire 1 is not limited to what will be explained below. Any assembly procedure of the shield electric wire 1 may be used as long as the shield connector 10 as shown in FIG. 1 is made after the assembly, and therefore, each step shown below may be performed in any given order as necessary.

First, the external insulating covering 5 is removed at the distal end portion of the shield electric wire 1 cut into a predetermined length, so that the exposed portion 4A of the shield unit 4 is exposed, and the exposed shield unit 4 is cut by a necessary length to let the internal insulating covering 3 exposed. The distal end portion of the shield electric wire 1 is inserted into the shield member 12 along the outer surface of the internal insulating covering 3, and the first tubular unit 31 is inserted between the exposed portion 4A of the shield unit 4 and the internal insulating covering 3, and then the shield pipe 15 is swaged from the outside of the exposed portion 4A, so that the shield member 12 is fixed to the shield electric wire 1, and is electrically connected to the shield unit 4. Subsequently, the distal end portion of the shield electric wire 1 is inserted along the outer surface of the internal insulating covering 3 into the first seal member 13 and then into the connection member 11, and the first seal member 13 is pressed into the space between the internal insulating covering 3 and the inner peripheral surface of the second extended portion 24, and the second extended portion 24 of the connection member 11 is inserted into the second tubular unit 32 of the shield member 12. At the same time, the outer surface of the connection member main body 21 and the flanged portion 34 of the shield member 12 are brought into contact with each other, and the latched portion 35 of the shield member 12 is latched to the latching claw 26 of the connection member 11, and the connection member 11 and the shield member 12 are fixed with each other. The second seal member 14 is attached to the recessed groove portion 25 of the connection member 11, and the terminal metal piece 9 is crimped to the conductive body 2 of which distal end portion of the internal insulating covering 3 is removed and exposed.

As described above, the connection member 11, the shield member 12, the first seal member 13, the second seal member 14, the shield pipe 15, and the terminal metal piece 9 are attached to the distal end portion of the shield electric wire 1, and in this state, the shield electric wire 1 is inserted into the insertion hole 7 of the metal case 6 from the side of the terminal metal piece 9. Then, while the second seal member 14 is caused to slide on the inner peripheral surface of the insertion hole 7, and the first extended portion 23 of the connection member 11 is pushed and inserted, and the connection member main body 21 is caused to be in contact with the outer surface of the metal case 6. Subsequently, the bolt 16 inserted into the connection member main body 21 and the flanged portion 34 of the shield member 12 is fastened to the bolt hole 8 of the metal case 6, and the connection member 11 and the shield member 12 are fixed to the metal case 6 and electrically connected thereto. Further, the corrugated tube 17 is inserted from the other end side of the shield electric wire 1, and the distal end portion of the corrugated tube 17 is fixed to the shield member 12 or the connection member 11 with an adhesive tape and the like, not shown, so that the assembly of the shield electric wire 1 to the metal case 6 is completed.

As described above, according to the present embodiment, the first tubular unit 31 of the shield member 12 is inserted between the internal insulating covering 3 and the exposed portion 4A of the shield unit 4 of the shield electric wire 1, and the shield pipe 15 is swaged from the outside of the exposed portion 4A and is fixed, so that the connection with the shield member 12 can be made without folding back the shield unit 4, and therefore, the precision of the diameter size of the connection portion can be enhanced. The connection portion of the shield member 12 of the shield unit 4 of the shield electric wire 1 is located outside of the metal case 6, and at the outer side of the connection portion, the external insulating covering 5 is removed, and therefore, only the conductive body 2 and the internal insulating covering 3 of the shield electric wire 1 of which external diameter tolerance is small are inserted into the electric wire guiding unit 22 of the connection member 11, and the precision of the inner diameter of the electric wire guiding unit 22 can be enhanced, and the gap with the internal insulating covering 3 can be reduced. Therefore, even when external force for bending the shield electric wire 1 is exerted, a large gap is not formed between the internal insulating covering 3 and the electric wire guiding unit 22, and the reduction of the water-stop property can be prevented. Further, the space between the inner surface of the electric wire guiding unit 22 and the outer surface of the internal insulating covering 3 is sealed with the first seal member 13, and the space between the inner surface of the insertion hole 7 of the metal case 6 and the outer surface of the first extended portion 23 of the connection member 11 is sealed with the second seal member 14, and the precision of the size between these members can be enhanced, and therefore, the water-stop performance can be further improved.

In the embodiment, a coaxial cable is shown as an example of the shield electric wire 1, but the present invention can also be usable as a shield connector structure in a case where a shield electric wire having a conductive body including multiple core wires is connected, and in this case, the extended portions and the like of the shield member, the first seal member, the second seal member, and the connection member may be formed in a tubular shape having an elliptic cross section or an oval cross section. Examples of connection target objects are not limited to a motor, an inverter, a battery, and the like used for an electric car and a hybrid car, and may be other appropriate electric devices, or electric connection boxes having electric components therein. The target to which the shield electric wire is ground connected is not limited to the metal case 6, and may be a portion provided for earth connection (ground connection).

REFERENCE SIGNS LIST

1 shield electric wire
2 conductive body
3 internal insulating covering
4 shield unit
5 external insulating covering
6 metal case (connection target object)
7 insertion hole
10 shield connector
11 connection member
12 shield member
13 first seal member
14 second seal member
15 shield pipe (fixing member)
17 corrugated tube (exterior member)
21 connection member main body
22 electric wire guiding unit
23 first extended portion
24 second extended portion
31 first tubular unit
32 second tubular unit
33 stepped unit

The invention claimed is:

1. A shield connector structure for inserting a shield electric wire having a conductive body, an internal insulating covering, a shield unit, and an external insulating covering into an insertion hole of a connection target object from one side of the insertion hole to another side of the insertion hole and connecting the shield electric wire to the connection target object, the shield connector structure comprising:

a conductive connection member in which the shield electric wire is inserted and which is directly attached and fixed to one surface of the connection target object located to the one side of the insertion hole;

a conductive and tubular shield member consisting of a single member, connecting the connection member and the shield unit of the shield electric wire, and directly attached to the connection member; and a circular fixing member being configured to fix the shield unit of the shield electric wire to the shield member and being a different member from the shield member and the shield unit, wherein the connection member includes a connection member main body fixed to the one surface of the connection target object and an electric wire guiding unit penetrating through the connection member main body and allowing the shield electric wire to be inserted therein, the connection member main body includes a first surface configured to directly attach and fix to the one surface of the connection target object, and a second surface being parallel to and opposite to the first surface, the shield member includes: a shield connection unit directly fixed to the second surface of the connection member main body; and a first tubular unit continuing from the shield connection unit and extending in a direction away from the second surface of the connection member main body, and the first tubular unit is inserted between the internal insulating covering and the shield unit of the shield electric wire, and the fixing member is swaged from an outside in a diameter direction of the shield unit toward the first tubular unit, so that the shield unit of the shield electric wire and the shield member are electrically connected.

2. The shield connector structure according to claim 1, wherein the connection member is comprised of a tubular first extended portion extending from the connection member main body to the insertion hole of the connection target object, and the shield connector structure further includes:

a first seal member directly attached to an inner surface of the electric wire guiding unit of the connection member and an outer surface of the internal insulating covering of the shield electric wire, and located between the circular fixing member and the connection target object in an axial direction of the conductive body; and a second seal member interposed between an outer surface of the first extended portion of the connection member and an inner surface of the insertion hole of the connection target object.

3. The shield connector structure according to claim 2, further comprising an exterior member provided at an outside of the connection member main body to cover the shield electric wire, the first tubular unit, and the fixing member from an outside in a diameter direction of the conductive body.

4. The shield connector structure according to claim 1, wherein the connection member is comprised of a tubular second extended portion continuing from the connection member main body, and extending in a direction away from the second surface of the connection member main body, the shield member includes a second tubular unit located between the first tubular unit and the connection target object in the axial direction of the conductive body and formed to have a large diameter, and a stepped unit coupling the first tubular unit with the second tubular unit, and the second tubular unit and the stepped unit cover the second extended portion of the connection member.

5. The shield connector structure according to claim 4, further comprising an exterior member provided at an outside of the connection member main body to cover the shield electric wire, the first tubular unit, and the fixing member from an outside in a diameter direction of the conductive body.

6. The shield connector structure according to claim 2, wherein the connection member is comprised of a tubular second extended portion continuing from the connection member main body, and extending in a direction away from the second surface of the connection member main body, the shield member includes a second tubular unit located between the first tubular unit and the connection target object in the axial direction of the conductive body and formed to have a large diameter, and a stepped unit coupling the first tubular unit with the second tubular unit, and the second tubular unit and the stepped unit cover the second extended portion of the connection member.

7. The shield connector structure according to claim 6, further comprising an exterior member provided at an outside of the connection member main body to cover the shield electric wire, the first tubular unit, and the fixing member from an outside in a diameter direction of the conductive body.

8. The shield connector structure according to claim 1, further comprising an exterior member provided at an outside of the connection member main body to cover the shield electric wire, the first tubular unit, and the fixing member from an outside in a diameter direction of the conductive body.

9. The shield connector structure according to claim 1, further comprising a first seal member directly attached to an inner surface of the electric wire guiding unit of the connection member and an outer surface of the internal insulating covering of the shield electric wire, and located between the shield member and the connection target object in an axial direction of the conductive body.

10. The shield connector structure according to claim 1, wherein the shield member includes a flanged portion which is formed to have substantially a same external shape as the connection member main body, and the flanged portion is provided to be in contact with the second surface of the connection member main body.

11. The shield connector structure according to claim 1, wherein each of the connection member and the shield member includes a bolt insertion hole, and wherein the connection member and the shield member are fixed to the connection target object by inserting a single bolt into the bolt insertion hole of the connection member and the shield member.

* * * * *